United States Patent [19]

Sarrazin

[11] Patent Number: 4,674,241

[45] Date of Patent: Jun. 23, 1987

[54] TELESCOPIC STRUCTURE INTENDED TO BE USED AS SHELTER FOR SPORT SURFACE AREA, CULTURE AND THE LIKE

[76] Inventor: Jean-Louis Sarrazin, Chemin de Charbonneau, 79700 La Chapelle Largeau, France

[21] Appl. No.: 784,688

[22] PCT Filed: Jan. 31, 1985

[86] PCT No.: PCT/FR85/00016

§ 371 Date: Sep. 27, 1985

§ 102(e) Date: Sep. 27, 1985

[30] Foreign Application Priority Data

Jan. 31, 1984 [FR] France ..... 84 01645

[51] Int. Cl.[4] ..... E04G 1/346

[52] U.S. Cl. ..... 52/67

[58] Field of Search ..... 52/9, 10, 67

[56] References Cited

U.S. PATENT DOCUMENTS

| | | | |
|---|---|---|---|
| 2,789,668 | 4/1957 | Martin | 52/67 |
| 3,248,830 | 5/1966 | Maynard | 52/67 |
| 4,175,361 | 11/1979 | Kumode | 52/67 X |
| 4,271,644 | 6/1981 | Rilliet | 52/67 |

FOREIGN PATENT DOCUMENTS

| | | | |
|---|---|---|---|
| 1213591 | 3/1966 | Fed. Rep. of Germany . | |
| 2151929 | 4/1973 | Fed. Rep. of Germany | 52/67 |
| 2384920 | 10/1978 | France . | |
| 2413507 | 8/1979 | France | 52/67 |
| 2442929 | 8/1980 | France | 52/67 |
| 2498236 | 7/1982 | France . | |
| 2512086 | 3/1983 | France . | |

*Primary Examiner*—Carl D. Friedman

*Attorney, Agent, or Firm*—Berman, Aisenberg & Platt

[57] ABSTRACT

Structure comprising stationary and movable elements ensuring perfect stability of the latter in folded and unfolded position or in any intermediate position, and the recovery of the rain waters by means of metallic frame members of the structure. Each member comprises two lateral vertical flanks 1*a*, 2*a*, 3*a*, 4*a*, comprising of a rectangular frame closed in the case of the stationary members and open in the case of the movable members as to circumscribe the frame of the preceding member and to be inscribed in that of the following member in the nesting order. The frames are in a vertical plane passing through a rail on the ground, and comprise upper hollow elongated members 1*d*, 2*d*, 3*d*, 4*d* and lower ones 1*e*, 2*e*, 3*e*, 4*e* ensuring the guiding translation motion of the members with respect to each other and the recovery of the rain waters and the transfer of rainwater at the ground level, the frames being connected with each other by extensible boarding members 15 and 16.

14 Claims, 8 Drawing Figures

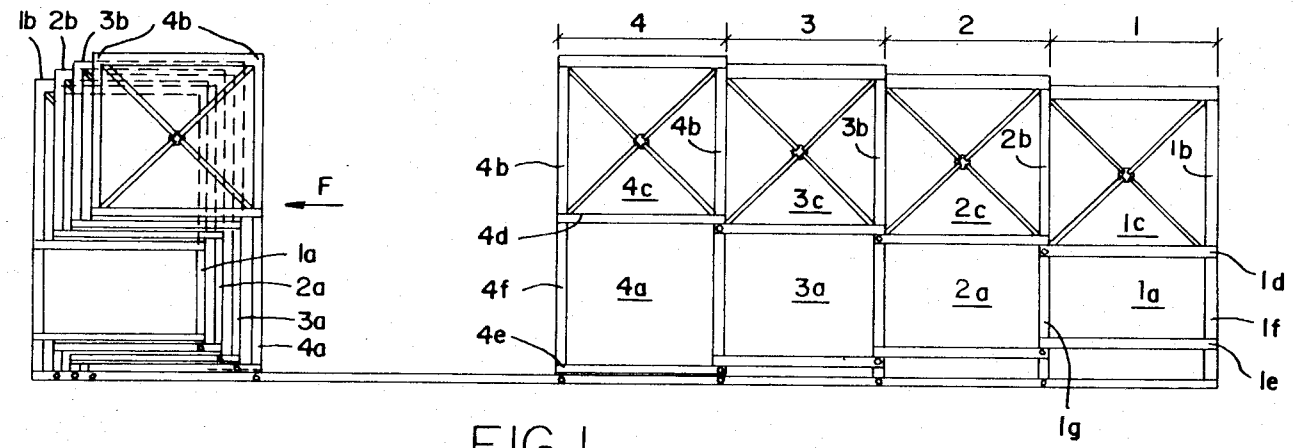
FIG. 1
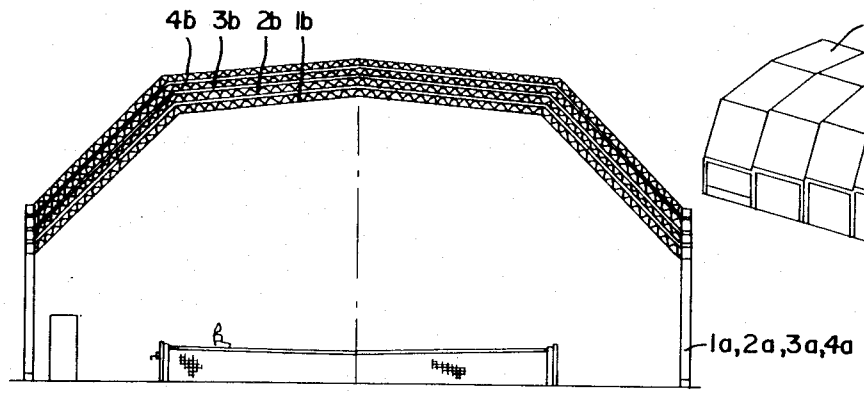
FIG. 2
FIG. 3

FIG. 4
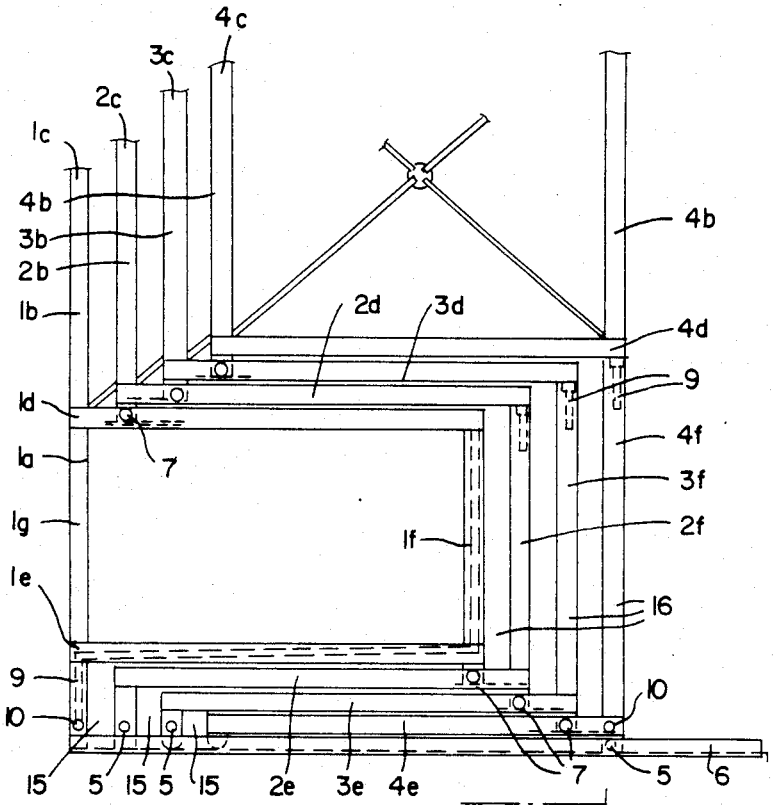
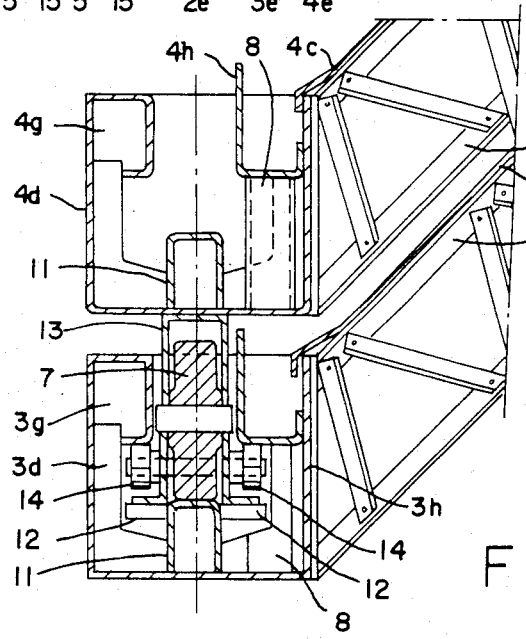
FIG. 5

FIG. 6
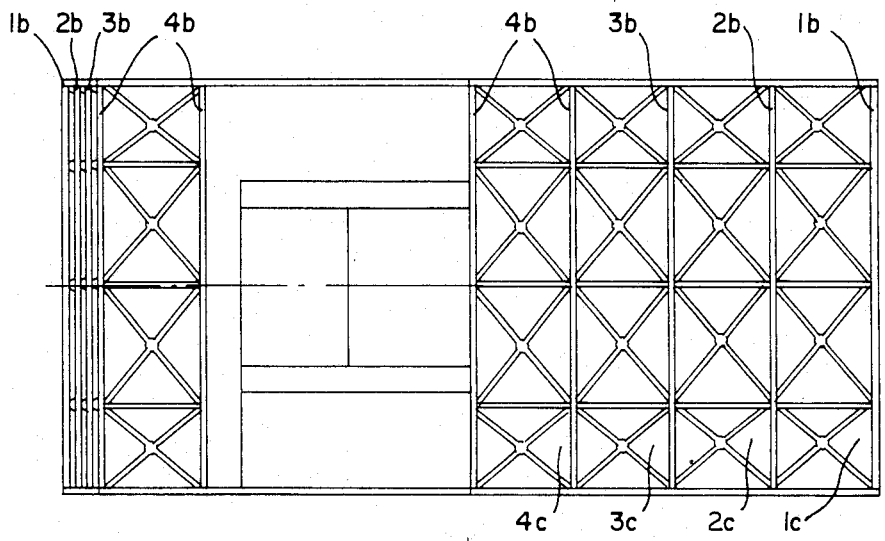
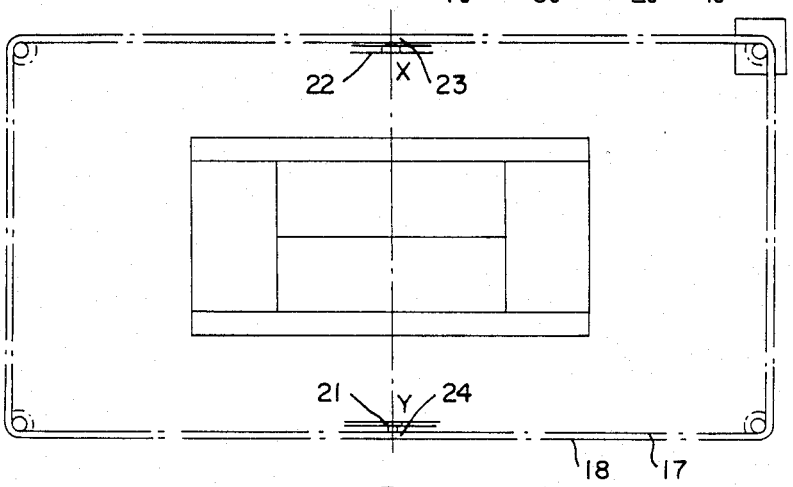
FIG. 7
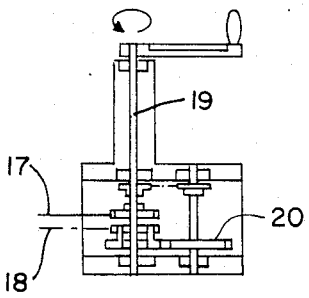
FIG. 8

TELESCOPIC STRUCTURE INTENDED TO BE USED AS SHELTER FOR SPORT SURFACE AREA, CULTURE AND THE LIKE

SUMMARY OF THE INVENTION

The present invention relates to the building structures intended to partially or wholly recover a delimited surface area on the ground, as could be the case, particularly for play or sport surface areas, such as tennis courts, swimming pools, basket fields and the like, the delimitation of the recovered surface being provided by the mobility of the structure members.

In this field, devices consisting of a cover integral to metallic supporting members which are pivotally connected with each other, each of said members laying on the ground by means of chariots which are movable on rails which are generally disposed in parallel relationship to the major side of the field to be covered. The supporting members consist of arches located in side vertical plans, one of said support members being stationary with respect to the ground, the other being stored by stacking on the latter in the folded position thereof. In this kind of devices, the vertical boardings as well as the cover members only consist of a web or tilt which may be folded or unfolded during the translation of the constitutive parts of the building just realized. Other technical embodiments slidably support the flexible member by forming the cover by means of stationary arches; the sliding of the web may be affected by part members either longitudinally along the purlins, or by moving said purlins while sliding the ends thereof in the elongated members constituting the arches. These different embodiments have the disadvantages either to provide an important side projection with respect to the limits of the surface to be covered due to the fact that there are on the ground as rails as movable members, or the requirement of an exagerated extension of said surface area of the amount required for the translation of the movable members, extension which would be more required as the number of said members is reduced, or a lack of stability of the arches constituting the metallic frame either in unfolded position or in folded position.

The aim of the invention is to obviate these various disadvantages. One of the aims of the invention is to enable the folding or unfolding operations of the structure by translation of a determined member of constitutive members on a sole side rail parallel to each of the major sides of the surface area to be covered; an another aim of the invention is to ensure the stability of the movable elements in extreme folded or unfolded positions as well as in any intermediate positions; finally another aim of the invention is to provide the recovery of the rain waters by means of the members of the metallic frame of the structure.

The structure, object of the invention, consists, according to the known embodiment, of a certain number of elements able to be assembled in a nesting fashion, two of them corresponding to each of the ends of the surface to be recovered being stationary, the other ones being movable in translation on a sole rail. Each element comprises two slide flanks constituting the self-supporting part of the structure on which bear a sequence of lattice beams mounted as to form arches having a polygonal contour. Each vertical flank of each member consists of a rectangular frame made by mechano-welding while starting from hollow elongated members having a square cross section, which frame is open at one of the vertical ends as to enable the frame of the neighour members to be inserted along its height, allowing a folding in line of all the members in the nesting fashion. The sole frame of the stationary ends members is closed. The sliding of the members is provided, on the one hand, by means of running rollers which are mounted on brackets fixed under the lower horizontal members of each frame at right angle to each vertical upright of the later running on a rail located within the lower horizontal member of the contiguous frame and, on the other hand, by means of running rollers located on the other end of said lower horizontal members of each frame and running on the rail common to all the members anchored in the ground. Similarly, the upper horizontal members of each frame comprise at the end thereof on the open side of the frame, a running roller circulating on a rail located within the upper horizontal members of the contiguous frame. The assembly of these running rollers is provided with side guiding rollers ensuring a sliding of the members according to a perfect alignment and with rollers intended to avoid any risk of tilting up. The lattice beams constituting the upper part of the structure and connecting the vertical side flanks the members abut on the vertical faces of the upper horizontal elongated members of the frames constituting said flanks; these beams are covered by covering elements pannels or web, which are intended to partially cover said elongated members in the lower portion of this slope on purpose to recover within the later the streaming waters; these waters thus recovered may be conducted by the proper elongated members towards the end thereof in connection to the vertical upright of each frame wherein is delimited an outlet pipe extending within the lower horizontal elongated members of the frame as to clear outside at the level of the ground, by means of a part of vertical pipe, the water being able to be then conducted to the pipeline system by means of a channel provided in the solid mass supporting the translation rail common to the members. The void portion of the frames of the vertical flanks of the elements, which is required for the assembling in the folded position is balanced in the unfolded postion by means of extensible boarding members, which are located by pleated folding between the vertical uprights of the frames in the folded position.

The accompanying drawings illustrate by way of non-limiting example one embodiment of the device according to the present invention. The later shows:

in FIG. 1, an elevation view of a shutter structure having two telescopic portions, one of them being in the folded position and another in the unfolded position;

in FIG. 2, a transversal view according to F of the shutter structure corresponding to FIG. 1;

in FIG. 3, a perspective view of an embodiment in the unfolded position ensuring the whole cover of a ground surface area, in FIG. 4, the detail of the frames of the vertical side flanks of the elements of the structure, shown in elevation, in FIG. 5, the detail, shown in cross section, of the translational guiding at the upper portion of the frame of the vertical flanks of the structure elements, vertical flanks of the elements of the structure, in FIG. 6, a top view of the shutter structure having one portion in the folded position and another in the unfolded position, in FIGS. 7 and 8, diagrammatic views of the handling mechanism for controlling the translation of the structure elements.

As shown in FIGS. 1, 2 and 6, corresponding to the embodiment of a shutter for a tennis court, the structure comprises two parts, each of them being comprised of one stationary end member 1 and of three movable members 2,3, and 4. Each element comprises two vertical side flanks 1*a*, 2*a*, 3*a*, 4*a* constituting the self-support portion of the structure. Each of said flanks supports at its ends two lattice frames 1*b*; 2*b*, 3*b*, and 4*b* forming arches mounted on each other by means of cross-bars on which are fixed or stretched pannels or web elements 1*c*, 2*c*, 3*c*, and 4*c*: each vertical side flank of each member is formed by means of mechano-welding according to a rectangular frame, starting from hollow elongated members having a square cross-section in the example shown, this frame is closed in the stationary member 1 and open at one end in the movable members 2,3 and 4. Thus, in the case of the stationary member 1, the frame is formed of an upper elongated member 1*d*, of a lower elongated member 1*e* connected with each other by vertical uprights 1*f* and 1*g*, the later standing up to the ground. In the case of movable members 2, 3 and 4, the frame consists of an upper elongated member 2*d*, 3*d*, 4*d* and of a lower elongated member 2*e*, 3*e*, 4*e*, respectively connected with each other by a vertical upright 2*f*, 3*f*, 4*f* located at one of the ends thereof so that each open frame thus obtained may successively circumscribe, starting from the stationary member, the preceding member in the folded position of the structure. For each movable member, at the open side of the frame, the end of the lower elongated member bears on the ground by means of a base support carrying at the lower end thereof a roller 5 circulating within the rail 6 sealed to the ground; on the same open side, the end of the upper elongated member of each frame is located within the upper elongated member of the frame of the member which is inscribed therein by means of a roller 7. For each movable, member, on the closed side of the frame, the end of the lower elongated member is also located within the lower elongated member of the frame of the member which is circumscribed therein by means of a roller 7, the movable member which is the farthest from the stationary member being supported by means of a roller 5 running within the rail 6. Similarly, and on purpose to ensure a self-stability of the stationary member 1, the corresponding end of the lower elongated member of its frame laze by means of a roller 7 within the lower elongated member of the frame of the member 2.

FIG. 5 shows the detail of the devices for the translational guiding of the movable members 3 and 4 of the structure. Each upper elongated member of frame 3*d* or 4*d* has a hollow square cross-section, open at the upper portion thereof according to a central portion web by means of an elongated flange 3*g* or 4*g* obtained by folding one of the vertical flanks of the elongated members and by means of a fixed flange 3*h* or 4*h* which is L-shaped and welded on the other vertical flanks of the elongated member at the inner side of the structure. This flange member 3*h* or 4*h* is intended to operate as a slab enabling the rain water to be recovered from the slopes of the roof: to this end, the lower edge of the pannels or web members 3*c* or 4*c* forming the later projects into this flange 3*h* or 4*h* having a vertical portion extending beyond the upper face of the elongated member 3*d* or 4*d* as to operate as a deflecting member. The recovered water flows towards the end of the elongated member at the closed side of the frame through a conduct 8 connected to a discharge pipe 9 located in the vertical upright 3*f* or 4*f*, directly flowing outside by means of an opening 10 located at the lower portion of said vertical upright or at the lower portion of the vertical support member located at the end of the lower elongated member 3*e* of the frame at the open side thereof. The rain waters are then transferred by means of a channel which is possibly provided in the solid mass of the rail 6. Each upper elongated member 3*d* or 4*d* comprises at the central portion thereof an inverted U-shaped rail which is welded on the lower inner face of said portion and the upper face of which operates as a rolling path for the roller 7, the lateral faces operating as a rolling path for both side guiding rollers 12. The bracket 13 bearing the roller 7 and welded under the upper elongated member of the circumscribed member bears two rollers 14 located on both sides of the roller 7, which rollers 14 being supported at the edge member 3*g* or 4*g* and under the affixed elongated member 3*h* or 4*h*, on purpose to avoid the risks of tilting up. The structure of the upper elongated members 2*c* and 1*d* is identical in all embodiments 3*d* and 4*d* as described: the structure of the lower elongated members 2*e*, 3*e* and 4*e* differs from that of the upper elongated members in that there is no device intended to recover the rain waters; the rollers 14 intended to avoid the tilting up are mounted in this case under a corner flange at right angles to the radical flanks of the elongated member as to be substituted for the edge elongated member or the affixed elongated member. Such a structure of each member ensures in all positions the later to be perfectly stable without risk of tilting by means of a direct report to the ground of the weight thereof and by means of the contiguous members. From the description, it appears that all frames and their translational guiding means are located in the vertical plane passing through the rolling rail on the ground.

The frame 1 of the side vertical flank 1*a* of the stationary member as well as the transversal wall 1*h*, are provided with a rigid boarding, this member forming the gable of the shutter structure: in the recesses separating the vertical base supports on the ground for the structure members, as well as in the recesses separating the vertical uprights 1*f*, 2*f*, 3*f*, and 4*f* of said members are respectively inserted extensible boarding members 15 and 16 passing from a pleated folded position to a stretched position at the end of translation of the movable members.

In FIGS. 7 and 8 are shown the units for controlling the unfolding or folding positioning of the structure. These units consist of two driving chains 17 and 18 mounted in closed circuit, as regard the running direction, which are inverted starting from a sole driving 19 manually or mechanically driven by means of a gear 20 for inverting the motion. Thus, for instance, the member 4 located upside of the junction line xy of the two structure portions is driven in translational motion simultaneously by the chains 17 and 18, the fixing points of the later on the relative member being respectively at 21 and 22; similarly, the member 4 located left side of the line xy is driven in translational motion simultaneously by the chains 17 and 18, the fixing points on said member being at 23 and 24, respectively.

The invention is not limited to the special embodiment herein described, it encompasses the whole possible alternatives forms with the condition that the latter be not in contradiction to the object of each of the claims appended to the present specification. Thus, for example, without departing from the scope of the invention, the arrangement of the members may be inverted, the end stationary member being the upper, whereas the movable members are closed to be hold inside the latter along decreasing size.

The shelter structure, object of the invention, may be used for ensuring the cover of all ground surface areas, whatever may be the kind of the later, culture ground or sport surface area, swimming pool as the like, as well as all fields for expositions or shows in case of momentary bad weather. The invention may be also applied to the recovering of all movable surface areas as could be the case, for example, for a vehicule platform, such as that of lorries, trailers, trucks and the like.

I claim:

1. A telescoping shelter comprising a stationary member comprising two stationary upstanding flanks, each of said stationary upstanding flanks comprising a closed frame, a plurality of movable members, each of said movable members comprising two movable upstanding flanks, each of said movable upstanding flanks comprising a frame which is open at one end, rail means for receiving each of said movable upstanding flanks and for guiding movement of said movable upstanding flanks, a plurality of lattice frame members each attached to a respective one of said stationary member and said movable members, and extensible boarding members extending between said frames for obturating voids between adjacent frames wherein each of the movable upstanding flanks of a first of said movable members at least partially circumscribes a respective one of said stationary upstanding flanks when in a collapsed position and each of said movable upstanding flanks of successive said movable members at least partially circumscribes a respective adjacent movable upstanding flank when in the collapsed position, said adjacent movable upstanding flank being one closer to said stationary upstanding flank.

2. Structure according to claim 1, wherein the frame of the stationary member comprise an upper elongated member and a lower elongated member connected to each other by vertical uprights comprising of hollow elongated members, the uprights extending up from the ground to ensure the anchoring of the stationary member.

3. Structure according to claim 2, wherein the end of the lower elongated member of the stationary member, on which abuts the vertical upright, is supported by means of a roller and by the lower elongated member of the movable member, which circumscribes it.

4. Structure according to claim 3, wherein the stationary flanks and a partition forming a gable between the stationary members are provided with a rigid boarding, recesses separating the vertical supporting members on the ground from the movable members, as well as recesses separating the vertical upright at the closed side of the side frame from said movable and stationary members being respectively provided with extensible boarding members which are transferred from a pleated folded position to a stretched position at the end of translation of the movable members, to obtain the maximum covering of the surface area on the ground.

5. Structure according to claim 3, wherein the upper elongated members of the frames of the side flanks of the stationary and movable members have a hollow square cross-section opening at the upper portion thereof according to a central row delimited, on the one hand, by an edge elongated member obtained by folding one of the flanks of the elongated member and, on the other hand, by an affixed elongated-member having the shape of an L welded on the other flank of the elongated member, at the inner side of the structure, a vertical flange of said affixed elongated member projecting beyond the upper face of the upper elongated member, which affixed elongated member operating as a slab intended to recover the rain water of the slopes of a roof, the lower edge of the members constituting the latter projecting to this aim within said elongated member, the recovered water being discharged towards the end thereof at the closed side of the frame through a conduit connected to a discharge pipe located in the vertical upright flowing outside by means of an elongated member located at the lower portion of said and or at the lower portion of the vertical supporting member located at the end of the lower elongated member, at the open side of the relative frame.

6. Structure according to claim 5, wherein the upper and lower elongated members comprise at the central portion thereof an inverted U-shaped rail which is welded on the lower inner face thereof, the upper face of which operates as a running path for the roller, whereas the lateral faces of said rail operate as a running path for both side guiding rollers mounted on each side of the brakets, which supports the latter, which bracket additionally comprises two rollers also mounted on each side of the roller, and mounted under the edge elongated members and the affixed upper elongated members or under the mere corner flange of the vertical flanks of the lower elongated members which are substituted for said edge elongated member and affixed elongated members.

7. Structure according to claim 1, wherein the frames of the movable members comprise an upper elongated member and a lower elongated member respectively connected with each other by means of a vertical upright located at one of the ends thereof.

8. Structure according to claim 7, wherein, for each movable member, at the open side of the frame, the end of the lower elongated member is supported on the ground by means of a vertical support provided at the end thereof with a roller running within said rail sealed to the ground.

9. Structure according to claim 8, wherein, for each movable member, at the open side of the frame, the end of the upper elongated member is supported by the upper elongated member of the frame of the element which is inscribed therein, by means of a roller.

10. Structure according to claim 1, wherein translation of movable members is ensured by means of two driving chains mounted in a closed circuit having inverted running directions from a sole driving shaft, said chains being connected to each of the movable members which are the farthest from the end stationary members at fixing locations located on inside vertical flanks opposite said movable members.

11. Structure according to claim 1, wherein, for each movable member, at the open side of the frame, the end of the upper elongated member is supported by means of a roller and by the upper elongated member of the frame of the element which is inscribed therein.

12. Structure according to claim 11, wherein for each movable member, at the closed side of each frame, the end of the lower elongated member is supported by means of a roller and within the lower elongated member of the frame of the element which circumscribes it.

13. Structure according to claim 11, wherein for the movable member which is the farthest from the stationary member at the closed side of the frame, the end of the lower elongated member is supported on the ground by means of a roller running within said rail which is sealed to the ground.

14. Structure according to claim 1, wherein the end of the lower elongated member of the stationary member, on which abuts the vertical upright, is supported by means of a roller and by the lower elongated member of the movable member, which circumscribes it.

* * * * *